US006126502A

United States Patent [19]

Hull

[11] Patent Number: 6,126,502

[45] Date of Patent: Oct. 3, 2000

[54] DIVING FIN

[76] Inventor: Martin Philip Hull, 125 Johnson Rd., Port Angeles, Wash. 98363

[21] Appl. No.: 09/413,284

[22] Filed: Oct. 6, 1999

[51] Int. Cl.[7] ..... A63B 31/11

[52] U.S. Cl. ..... 441/63

[58] Field of Search ..... 441/60–64

[56] References Cited

U.S. PATENT DOCUMENTS 3,268,927 8/1966 Markowitz ..... 441/63

*Primary Examiner*—Jesus D. Sotelo
*Attorney, Agent, or Firm*—Douglas A. Chaikin; Peninsula IP Group

[57] ABSTRACT

Disclosed is a diving fin, securable about a swimmer's ankle, having a blade oriented at a propulsive angle independent of how the swimmer's toes are positioned. The blade can be positioned not to interfere with walking and wading. The blade and boot are lockably engageable, and are then rotatable to a locked deployed position wherein the blade projects past the swimmer's heel and in line with the swimmer's lower leg. In one embodiment, the blade has a connector and the boot has a hub lockably engageable therewith to attach or detach the blade. Thus, the boot can be worn without the blade. The engaged connector is upwardly rotatable behind the swimmer's leg. A strap secures the undeployed blade adjacent the leg. The connector is rotatable between the undeployed and deployed positions and is lockable in the deployed position. In one embodiment, the blade can wobble a few degrees when in the locked position. Releasable locking mechanisms are disclosed for keeping the blade attached to the boot and for limiting the orientation of the blade relative to the boot. Fasteners are disclosed for holding the blade in the undeployed position by its trailing end portion.

28 Claims, 7 Drawing Sheets

DIVING FIN

BACKGROUND OF THE INVENTION

1. Field of the Invention

This invention relates to swim fins, more particularly to high-performance diving fins and especially to fins for shore diving and amphibious activities.

2. Previous Art

As even the best swimmer knows, the human leg and foot are almost useless for propulsion in water. While the foot is an elegant adaptation for walking, it is blunt, stiff and naturally oriented at a right angle to the lower leg. By kicking harder, a swimmer actually wastes effort and increases drag. To recapture some of the aquatic performance that was sacrificed eons ago as the price of terrestrial evolution, swimmers wear fins. However, fins are clumsy on land and their propulsive effectiveness is limited by the configuration of the human knee and ankle, which make it difficult to angle the fin properly.

The angle of a fin is important because the fin propels the swimmer by imparting momentum to a mass of water, such that the swimmer gains equal momentum—and is moved—in the opposite direction. Generally, as the swimmer kicks, each fin reciprocates, its upper and lower surfaces alternately pressing against the water. Such reciprocation alone would only stir the water. However, because the fin bends, when a fin surface is pressing into the water, it is usually also facing at least partially toward the rear. Thus, during a complete stroke, the fin imparts a net rearward momentum to the water and the swimmer is correspondingly propelled forward.

The kicking movement employed by swimmers and divers can be described with reference to a starting position in which the leg is straight at the knee and in line with the long axis of the spine. First, the quadriceps relaxes and the hip flexor begins to contract. The hip flexor contraction moves or flexes the upper leg forward at the hip. The relaxation of the quadriceps allows the knee to bend as the upper leg moves forward. Once the knee has moved forward, contraction of the quadriceps straightens the leg at the knee, causing the foot and the fin to move forward. The bending at the knee orients the dorsal surface of the foot and therefore the dorsal surface of the fin blade at an angle, which imparts a rearward momentum to the water, propelling the swimmer forward.

Swimmers and divers employ two common kicking movements: the flutter kick and the undulating (or butterfly, or dolphin) kick. In the flutter kick, one leg flexes while the other leg extends. With this kicking movement, the weaker direction of movement (upper leg extension) will limit the muscles involved in the stronger direction of movement (upper leg flexion followed by lower leg quadriceps extension) to the levels of force established by the extension muscles, because the kicking movement must remain balanced. Much drag is created as the legs work against each other. In the undulating kick, both legs move in the same direction. Flexion at the hip is followed by contraction of the quadriceps to straighten the lower leg at the knee. Hamstring and gluteal contraction follow to extend the legs back to the starting position. The undulating kick usually involves greater angles of movement than the flutter kick.

Because conventional fins extend in the general direction of the toes, the fin angle depends on the angle of extension of the foot, which is limited to the range of motion of the ankle joint. During the return stroke, the swimmer can extend the foot and point the toes in order to angle the plantar (foot bottom) surface of the fin aft for fairly efficient propulsion. All too soon, however, the upper leg reaches the limit of its rearward motion and it is time to bring the leg forward and bend the knee in preparation for the next kick stroke. As the knee is bent and brought forward, the thigh, calf and heel create drag.

During the kick stroke, the powerful quadriceps muscle can be applied. However, most people's feet will not extend (point downward) far enough to place the fin at a propulsive angle during the whole kick stroke. This problem is only partly remedied by the flexibility of the fin. While flexibility can enable the distal portions of the fin surface to assume a propulsive angle after kicking force is applied, this flexing occurs only after significant energy has been wasted and leaves the proximal portion of the fin at an angle which produces much drag and little propulsion.

Even more seriously, the ligaments of the human ankle are too weak to withstand the full kicking force of the quadriceps driving a large fin in water. Swimmers who deliberately kick with full force while wearing a large fin will incur severe damage to their ankle ligaments. There are estimates that the quadriceps can generate up to three times the kicking force that the ankle ligaments can safely deliver to a large fin. Thus, a need exists to more quickly and more efficiently orient the fin at the ideal propulsive angle, especially during the kick stroke. A need also exists to couple the powerful kick of the quadriceps to a large diving fin without overloading the ligaments of the ankle.

Another difficulty with fins is encountered at the beach. Fins are clumsy for walking on any surface, even more so in shallow water, and especially in currents. The muscles that elevate the human foot are very weak and are no match for the power of the sea against a long SCUBA fin. Surf pounding against a long fin will easily trip and upset a wading diver. Although the diver may carry the fins into calm water and then put them on, the fins must be worn when entering surf, for a finless diver is a helpless diver and will be driven back onto the beach by even moderate waves. The results may be merely frustrating or they may be far more serious, depending on how urgently the diver needs to move along.

Divers would benefit were they able to walk, or even run, into shallow surf with their fins attached, but positioned so as not to interfere with foot placement. Particularly advantageous would be a way of attaching a fin to the lower leg and orienting the fin upward, adjacent the lower leg, and then quickly deploying the fin in a propulsive position once the water is deep enough for the fins to function. What is especially needed is a swim fin which allows a diver to wade against waves or surf in shallow water, which can be deployed quickly in the transition from wading to swimming, which is oriented at a propulsive angle during the kick stroke as well as the return stroke, and which enables the diver to kick powerfully yet comfortably and safely. Additionally, a swimmer whose foot is injured, malformed, or for any other reason cannot bear the forces that attend the use of a conventional diving fin would benefit from such an innovation.

SUMMARY AND OBJECTS OF THE INVENTION

It is an object of the present invention to provide a fin, which enables a swimmer to derive efficient propulsion from leg movement, and especially from contraction of the powerful quadriceps muscle, without sustaining injury to the ligaments of the ankle.

It is an additional object of the present invention to provide a fin, which facilitates a swimmer's entering and leaving shallow water at a beach or shoreline.

It is an additional object to provide such a fin, which is suitable for sprinting across a beach, plunging into surf, and rapidly deploying the fin without stopping to put the fin on.

It is an additional object to provide such a fin, which is substantially self-deploying when, released from the stowed position.

It is an additional object to provide such a fin, which can be worn by a person having an injured, malformed or missing foot.

In accordance with the aforementioned objects and those that will be mentioned and will become apparent below, a diving fin according to the present invention comprises:

a fin blade;

a boot for coupling the fin blade to the swimmer, the boot having a top, a bottom, a front, a back, a medial side and a lateral side, a boot longitudinal axis being defined by a line passing through the top and bottom substantially parallel to the back and the sides;

the fin blade being attachable to the boot;

the boot being capable of positioning the attached fin blade parallel to the boot longitudinal axis;

whereby the fin blade is held to the boot proximate the swimmer's ankle and projects past the swimmer's heel in line with the swimmer's lower leg, enabling the swimmer to kick powerfully and efficiently without hyperextension of the foot.

In an exemplary embodiment of a diving fin according to the present invention, the fin blade is detachable from the boot. This permits the swimmer to walk in the boot without the blade and attach the blade while wearing the boot.

In another exemplary embodiment of a diving fin according to the present invention, a standing swimmer can attach the blade from above and behind the boot and secure the blade end adjacent the back of the swimmer's leg for walking, wading or even sprinting a short distance. Once in the water, the swimmer can quickly free the blade end, rotate the blade down past the heel and lock it in line with the swimmer's lower leg. This allows a fast transition between land and water. With the blade already projecting from the boot in line with the lower leg, the swimmer does not need to point the toes of the foot in order to place the blade at a propulsive angle. The diving fin includes a locking mechanism, which fixes the blade in the propulsive position. In a preferred embodiment of a diving fin according to the present invention, such a locking mechanism is disposed on the ankle portion of the boot.

In another exemplary embodiment of a diving fin according to the present invention, a hub on the boot lockably engages a connector on the fin blade, facilitating quick attachment and detachment of the blade. In a preferred embodiment, a spindle on the connector engages a bore in the hub and a pin projects from the spindle into the bore, keeping the spindle aligned with the bore. The pin is manually releasable to allow the connector to be removed from the hub. In another exemplary embodiment, the hub is circular and is covered by a circular cap. A groove runs from the bore to the hub periphery and the cap has a restricted slot paralleling that of the hub and permits the matching profile of the spindle to slide from the periphery to the bore. The cap confines the spindle within the groove except at the periphery.

In yet another preferred embodiment, the cap periphery overhangs the hub periphery and the connector includes a key, which curls around the cap periphery toward the hub periphery. As the connector is rotated relative to the hub, the spindle centering pin in the bore restricts motion of the key to a circular arc following the periphery. The key stabilizes the connector, distributing torsional stresses away from the spindle to the cap via the key, which is trapped on the cap periphery.

In yet another preferred embodiment, a deployment lock is movably disposed on the ankle portion of the boot and is biased against the hub periphery. As the connector is rotated into the deployed position, the key urges the lock aside and enters a notch in the lock, whereupon the lock closes against the hub periphery and traps the key, limiting the range of rotation of the spindle. This holds the blade in the deployed position. In still other preferred embodiments, the notch and key are dimensioned to allow a small range of motion, enabling the blade to reach a new propulsive angle shortly after a reversal of the force applied to it by the swimmer.

Another exemplary embodiment of a diving fin according to the present invention has a pair of connectors attaching the blade to a pair of hubs located on the sides of the ankle portion of the boot. The connectors are lockably and rotatably attachable to the hubs and are lockable in the deployed (propulsive) position. Retaining straps hold the blades against the back of the leg when undeployed. In a preferred embodiment of a diving fin according to the present invention, the hubs and connectors include the mechanisms that lock the blade to the boot and fix the blade in the deployed position.

Also in accordance with the above objects and with those that will be mentioned and will become apparent below, a diving fin in accordance with the present invention comprises:

a fin blade;

a boot for coupling the fin blade to the swimmer, the boot having a top, a bottom, a front, a back, a medial side and a lateral side, a boot longitudinal axis being defined by a line passing through the top and bottom substantially parallel to the back and the sides;

the fin blade being attachable to the boot;

the boot holding the attached fin blade in an orientation substantially dependent upon the orientation of the boot, whereby the blade is oriented independently of the elevation and extension of the swimmer's toes and the swimmer is able to kick powerfully and efficiently without hyperextension of the foot.

In other exemplary embodiments of a diving fin according to the present invention, the boot, blade, hub and connector function as set forth for the previously mentioned embodiments. Various other aspects of the present invention are set forth below.

Also in accordance with the above objects and with those that will be mentioned and will become apparent below, a diving fin prosthesis for a swimmer having an injured, malformed or missing foot in accordance with the present invention comprises:

a fin blade;

a boot for coupling the fin blade to the swimmer's lower leg, the boot being securable about the distal regions thereof;

the fin blade being attachable to the boot;

the boot being capable of positioning the attached fin blade parallel to the swimmer's lower leg;

whereby the fin blade is held to the boot proximate the distal portion of the swimmer's lower leg and projects therefrom in line with the swimmer's lower leg, enabling the swimmer to kick powerfully and efficiently without having a foot to which a conventional diving fin would be secured.

An advantage of the present invention is that the deployed blade is not coupled to the toe portion of the swimmer's foot. Thus, the swimmer's ankle ligaments do not have to bear all the kicking force that is transmitted to the blade. Rather, the blade projects from a boot coupled about the ankle and about portions of the lower leg and the foot adjacent thereto, so that the boot distributes forces over the swimmer's instep, heel, ankle, and lower leg.

Another advantage of the present invention is that the blade is capable of reaching a propulsive angle during the kick stroke whether or not the swimmer's toes happen to be extended (pointed down, as when the calf muscles are fully contracted).

Another advantage of the present invention is that with the blade in the undeployed position the swimmer can wade, walk, and even sprint, activities difficult or impossible when wearing conventional fins.

Another advantage of the present invention is that the attached blade is rapidly deployable.

Another advantage of the present invention is that the blade is quickly attachable to the boot and quickly detachable therefrom.

Another advantage is that the benefits of high-performance diving fins are made available to swimmers whose feet are injured, malformed or missing.

BRIEF DESCRIPTION OF THE DRAWING

For a further understanding of the objects and advantages of the present invention, reference should be given to the following detailed description, taken in conjunction with the accompanying drawings, in which like parts are given like reference numerals and wherein.

DETAILED DESCRIPTION OF THE INVENTION

Figure 1:
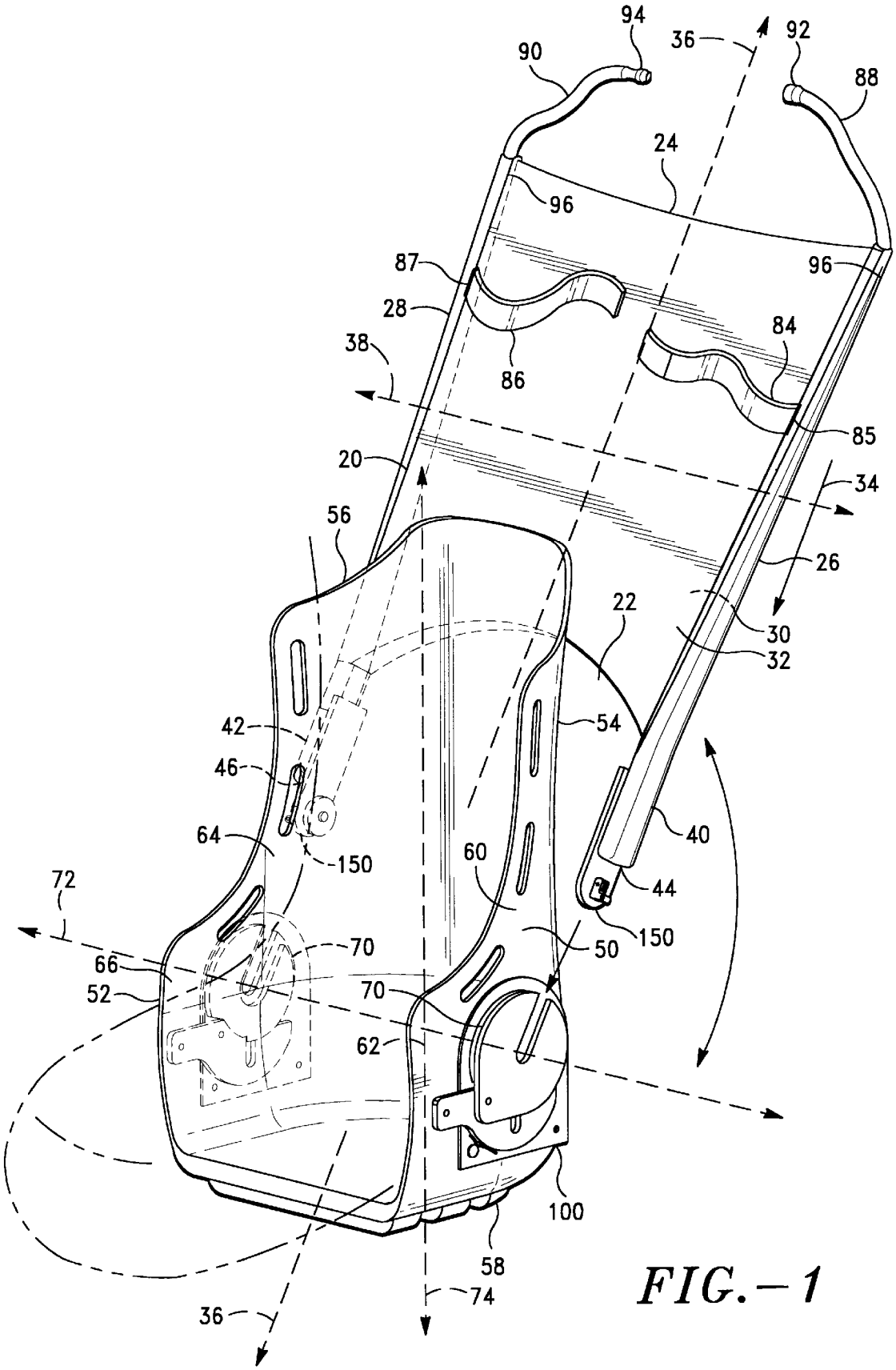
FIG. 1 is a perspective view of an exemplary embodiment of a diving fin according to the present invention.

The invention will now be described with reference to FIG. 1, which illustrates a side perspective view of an exemplary embodiment of a diving fin according to the present invention. The diving fin comprises a fin blade 20 having a leading edge 22, a trailing edge 24, a medial edge 26, a lateral edge 28, a top surface 30 and a bottom surface 32. For purposes of description, the forward direction is defined as being from the trailing edge 24 to the leading edge 22 as shown by the arrow 34. Also for purposes of description, a blade longitudinal axis 36 is defined by a line intersecting the leading edge 22 and the trailing edge 24. Similarly, a blade transverse axis 38 is defined by a line intersecting the medial edge 26 and the lateral edge 28 and intersecting the blade longitudinal axis 36 at a right angle. The medial and lateral edges 26 and 28 of the fin blade 20 project forward of the leading edge 22 to form rail-shaped medial and lateral connectors 40 and 42. Each connector 40 and 42 has a distal end portion 44 and 46 including a mating end 150.

The fin blade 20 has a length of approximately 16 to 24 inches and a width of approximately to 8 to 12 inches. The fin blade 20 is formed of polypropylene or another suitably rigid material. The fin blade has a stiffening rib running down each edge, tapering from about 1.75 inches near the portion that fits the diver's foot to about 0.5 inch at the distal end of the blade.

With continued reference to FIG. 1, a boot 50 is disposed about a swimmer's foot, ankle and lower leg. The boot 50 has a front 52 defining an opening, which encircles the arch and the instep of the swimmer's foot. The boot 50 has a back 54 covering the swimmer's heel, Achilles' tendon and lower calf muscle; a top 56, which encircles the swimmer's shin and calf; a bottom 58 covering the heel end of the sole of the swimmer's foot; a medial side 60 including a medial ankle portion 62 covering the medial surface of the swimmer's ankle joint; and a lateral side 64 including a lateral ankle portion 66 covering the lateral surface of the swimmer's ankle joint. A hub 70 is affixed to each ankle portion 62 and 66.

It will be appreciated that the invention is not limited to the above described boot portion. The boot 50 need not cover any particular portion of the lower leg. In some embodiments, it may be advantageous that the boot 50 extends well up gastrocnemius (calf muscle) with strapping up high on the shin to adequately distribute forces over enough tissue surface area. Compression and shear forces must be distributed over enough area so the tissue does not fail. It is believed that, in fact, the boot may extend to just below the user's knee with successful operation of the diving fin.

With continued reference to FIG. 1, there is shown, the boot having a boot transverse axis 72 being defined by a line passing between the hubs 70. Similarly, the boot has a longitudinal axis 74, which is defined by a line intersecting the boot transverse axis 72 at a right angle and being roughly parallel to the back 54 of the boot 50. In use, FIG. 10, a swimmer wears the boot so that the boot longitudinal axis 74 is generally aligned with the swimmer's tibia and fibula and the boot transverse axis 72, and in general passes through the swimmer's medial and lateral malleoli and is generally aligned with the axis of elevation and extension of the swimmer's foot about the ankle joint. A fastener assembly 76 (FIG. 2) secures the boot 50 to the swimmer. The fastener assembly 76 completes the front 52 of the boot and may be closed by means of clasping, hooking, knotting, buckling and the like. The front 52, back 54, bottom 58 and sides of the boot 50 are reinforced as appropriate to comfortably and firmly stabilize the boot 50 on the swimmer. FIG. 1 depicts the fin blade 20 positioned above and behind the boot 50 with the fin blade connectors 40 and 42 angled downward and forward and pointing toward the hubs 70.

Figure 2:
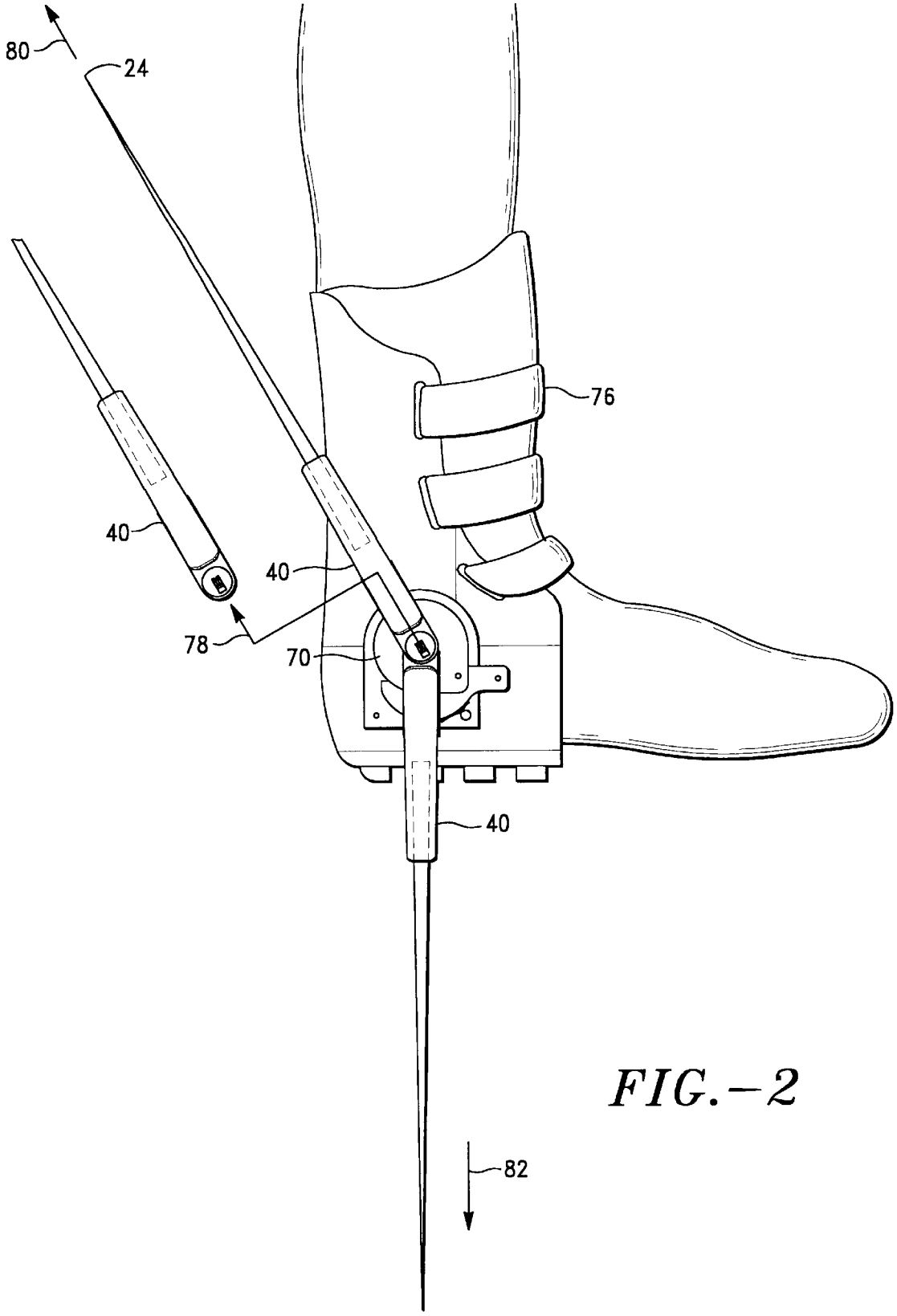
FIG. 2 is a side view of an exemplary embodiment of a diving fin according to the present invention illustrating a deployed and an undeployed position.

Referring also now to FIG. 2, from the direction shown in FIG. 1 each connector 40 and 42 is insertable into a hub 70 as indicated by the arrows 78. Once inserted, the connector 40 locks into the hub 70 and cannot be detached until unlocked from the hub 70, as is set forth in detail with reference to FIGS. 3 and 4. While inserted and locked into the hub 70, the connector 40 is freely rotatable from an undeployed position (arrow 80) toward a deployed position (arrow 82). As is emphasized with reference to FIGS. 6 through 8, this freedom of rotation serves the critically important objective of protecting the swimmer from drowning. When the connector 40 reaches the deployed position 82, it locks in the deployed position 82 until unlocked, as is set forth in detail with reference to FIGS. 6 through 9.

Figure 10:
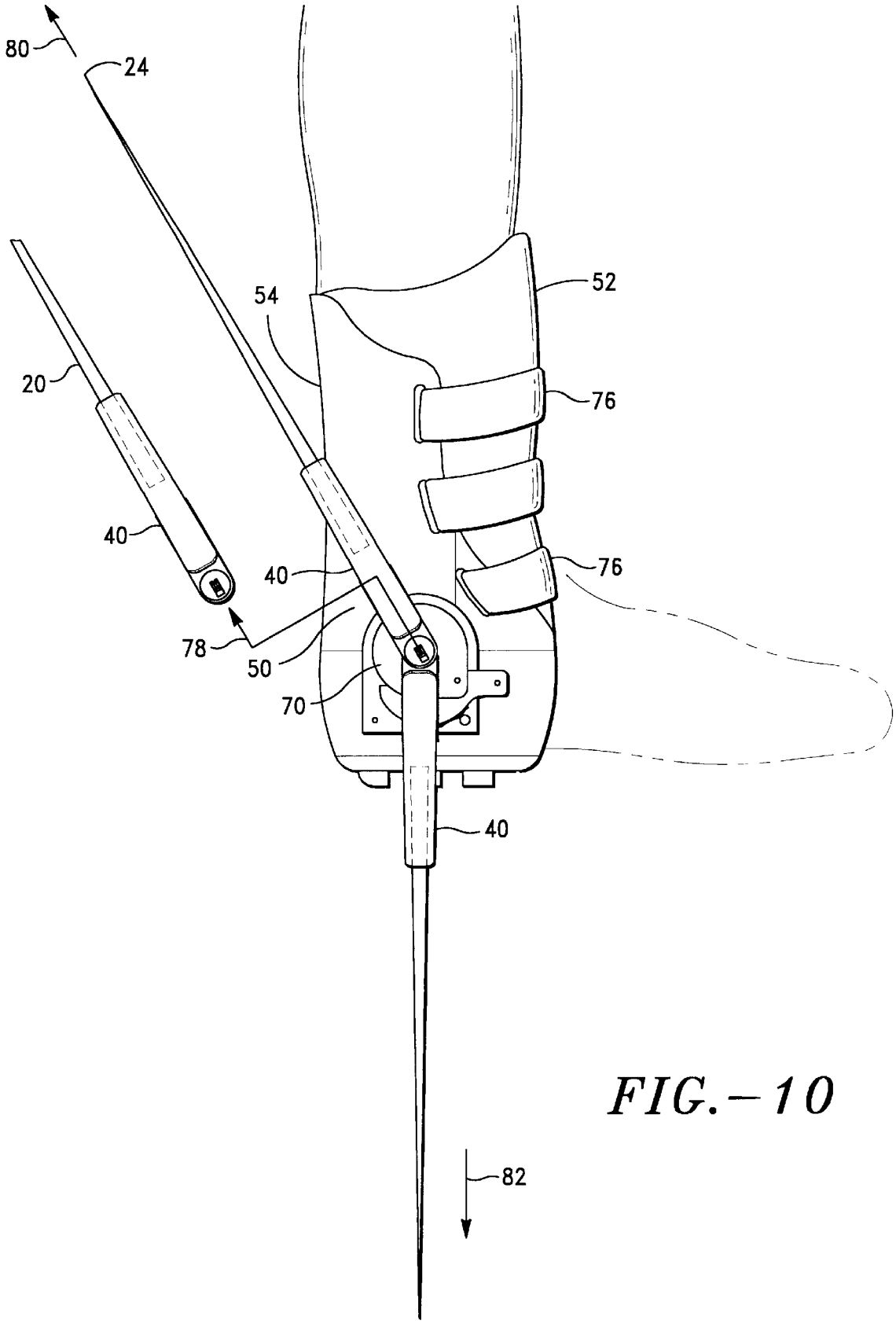
FIG. 10 illustrates an exemplary embodiment of the diving fin according to the present invention in use.

With continued reference to FIG. 2, in use a swimmer puts the boot 50 on and secures the fastener assembly 76. The swimmer may then walk in the boot 50 without attaching the blade 20 (FIG. 10). Alternatively, the swimmer may insert the fin blade connector 40 into the hub 70 and secure the trailing edge 24 of the fin blade 20 adjacent the back of the swimmer's leg, (FIG. 10) as is set forth in detail with reference to FIGS. 3 through 5. In this undeployed position 80, the fin blade 20 does not interfere with the acts of standing and walking. Because the undeployed fin blade 20 does not project forward beyond the swimmer's toes as does a conventional diving fin, it is unlikely to trip the swimmer or to apply large forces to the swimmer's foot when the swimmer stands in swiftly moving shallow water. Indeed, the swimmer may walk rapidly or even run a moderate distance—something not to be attempted with conventional diving fins. Because the trailing edge 24 of the fin blade 20 is doubled back toward the swimmer's knee, it is shielded from the current and has minimal leverage over the swimmer's leg.

Importantly, the fin blade 20 is held at the angle of the undeployed position 80 only at or near its trailing—distal—end 24 and not at or near the connector 40. If the connector 40 were allowed to lock at a fixed upward-projecting angle with the trailing edge 24 free, there is a danger that the swimmer's normal kicking motions would propel the swimmer in an unexpected direction. This would surprise the swimmer and could lead to unpleasant circumstances. For this reason, in a preferred mode of carrying out the invention, the hubs 70 are not capable of locking at any angle other than that of the deployed position 82. This mode is strongly recommended.

Referring to FIG. 1, a first restraining strap 84 extends from the fin blade 20 were the trailing edge 24 meets the medial edge 26. A second restraining strap 86 extends from the meeting of the trailing and lateral edges 24 and 28. The straps 84 and 86 are attachable by means of eyelets or slots (85 and 87) located within approximately 200 millimeters of the trailing edge 24 of the fin blade 20. The first strap 84 is covered with VELCRO wool, the second, 86, with VELCRO hooks. The swimmer adjusts the fin blade connector 40 to the undeployed position, brings the straps 84 and 86 together about his or her leg, and joins the straps 84 and 86 to hold the fin in the undeployed position. It will be noted that the fin blade 20 is flexible enough to wrap around the back of the swimmer's leg. Thus, the straps 84 and 86 need not be more than a few inches long. Importantly, the trailing edge 24 of the fin blade 20 is held adjacent the back of the swimmer's leg or nearly so, and thus will not propel the swimmer downward unexpectedly. When ready to deploy the fin blade 20, the swimmer pulls the straps 84 and 86 apart. Various other connections may be envisioned.

In an alternative embodiment, instead of straps, the fins may be restrained by cords 88 and 90 having quick-release pin-and-socket type connecting ends 92 and 94. Optionally, each cord 88 and 90 is elastic. Optionally, each cord 88 and 90 is retractably disposed in a tubular canal 96 in the medial or lateral edge 26 or 28 of the fin blade 20. Thus, only the connecting end 92 or 94 is exposed until the cord 88 or 90 is grasped and stretched by the swimmer. This reduces the drag and the possibility of entanglement while swimming. In use, the swimmer adjusts the fin blade 20 to the undeployed position, brings the first and second connecting ends 92 and 94 together about the leg and interlocks them to hold the fin blade 20 adjacent the back of the leg.

To deploy the fin, the swimmer disconnects the connecting ends 92 and 94, whereupon the cords 88 and 90 retract within the canals 96 and the fin blade 20 may rotate toward the deployed position 82.

As can be understood with reference to FIGS. 2 and 10, the swimmer may run, walk or crawl to a point where the water is deep enough to begin swimming. The swimmer may then release the trailing edge 24 of the fin blade 20 and, with moderate kicking motion, let the fin blade 20 rotate into the deployed position 82. When the swimmer feels the fin blade 20 locking into the deployed position 82, the swimmer knows the blade 20 is ready for propulsive use and may begin kicking vigorously.

Referring still to FIGS. 1 and 2, the boot 50 for this exemplary embodiment of a diving fin according to the present invention is stabilized relative to the swimmer's ankle and lower leg. In contrast, a conventional diving fin is stabilized relative to the swimmer's foot. The front 52, back 54 and sides of the boot 50 are stiff enough and secured tightly enough that, when the swimmer kicks, the boot 50 cannot wobble or rotate enough to abrade or bruise the swimmer. The fin blade 20 in the deployed position 82 projects beneath the swimmer's heel, roughly in line with the swimmer's tibia and fibula. Thus, when the swimmer kicks, the fin blade 20 is already at or close to a propulsive angle relative to the swimmer's lower leg. Importantly, the swimmer's foot does not have to be plantar flexed (i.e., the swimmer does not have to point his or her toes down in line with the lower leg) in order for the fin to attain a propulsive angle during the kick stroke. Thus, the swimmer may kick at maximum strength without straining his ankle ligaments. The swimmer's foot may be plantar flexed (i.e., toes pointed down) either out of habit or for the purpose of reducing drag; however, the swimmer's ankle joint ligaments do not bear the major part of the load during the kick stroke as they do with a conventional diving fin.

Referring back to FIG. 1, it can be seen that a flat platform 100 is affixed to the ankle portion of the boot 50. The hub 70 is affixed to the platform 100. The hub 70 is slotted to receive the connector 40 from a direction roughly corresponding to the undeployed position 80 of the fin blade 20.

Figure 3:
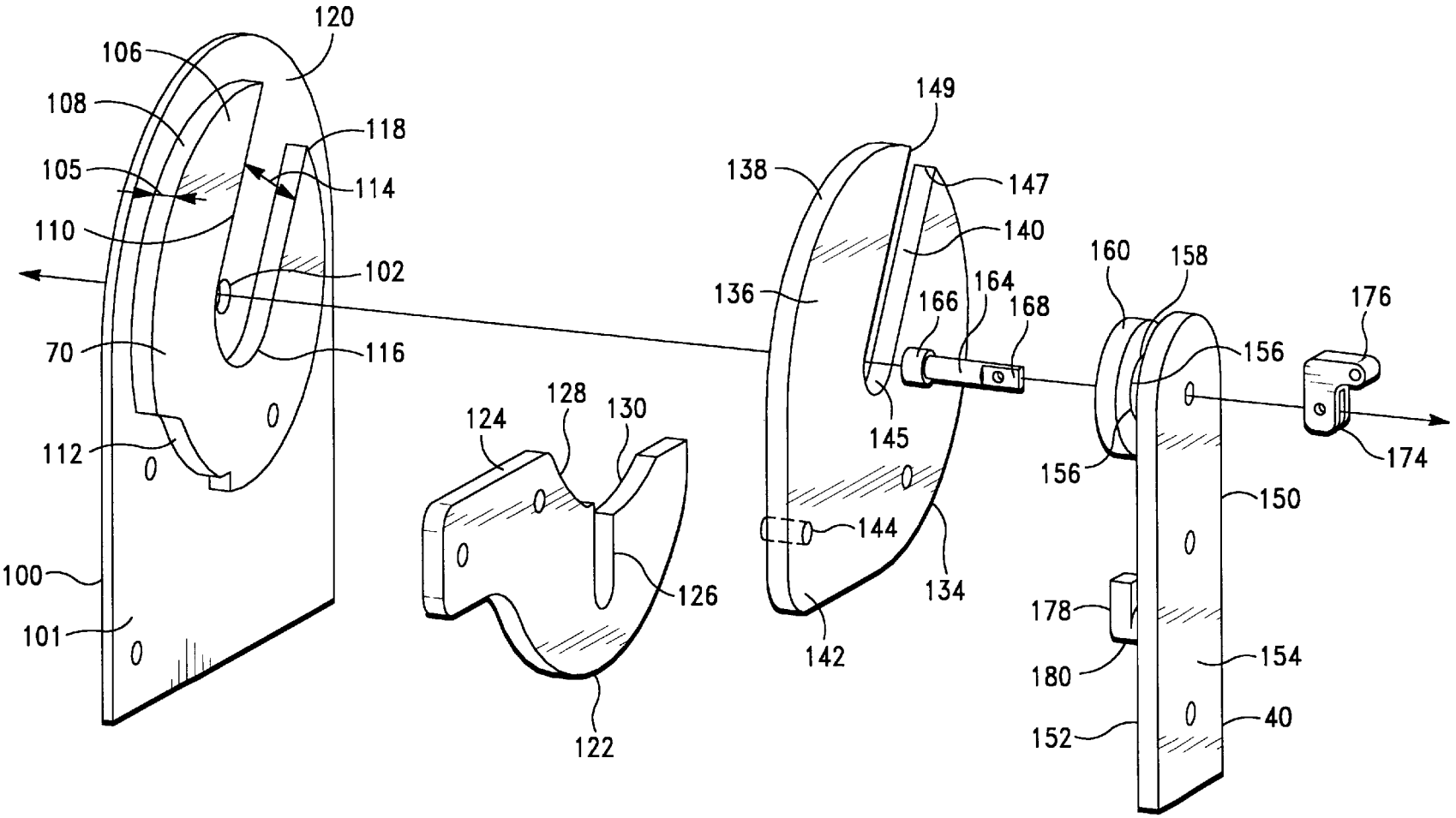
FIG. 3 is an exploded perspective view of portions of a mechanism for facilitating the exemplary fin blade to go from the deployed to the undeployed position.

With reference to FIG. 3, an exploded perspective view details the left lateral or right medial platform 100 and hub 70 (thus, a mirror image of FIG. 3 would depict the right lateral and left medial platform 100 and hub 70). The platform 100 includes a platform surface 101 and a center bore 102 therein which defines a hub axis 104. The center bores 102 of the platforms 100 of the medial and lateral ankle portions 62 and 66 of the boot 50 are mutually aligned and are also roughly parallel to and roughly aligned with the boot transverse axis 72 (see FIG. 1). The center bore 102 has a diameter of approximately 4 millimeters. The hub 70 is affixed to the platform 100. The hub 70 has a hub height 105, a hub face 106 and a hub periphery 108. The hub height 105 is approximately 4 millimeters. The hub periphery 108 describes a circle about the hub axis 104. The hub periphery 108 has a radius of approximately 20 millimeters.

With continued reference to FIG. 3, a linear receiving groove 110 is cut into the face 106 of the hub 70 and all the way through the hub 70 to the surface 101 of the platform 100. The receiving groove 110 has a groove width 114 of approximately 12 millimeters, a first groove end 116 describing a semicircle having a radius of approximately 6 millimeters about the hub axis 104 and a second groove end 118 which defines an opening 120 at the hub periphery 108. The receiving groove 110 defines an angle, relative to the boot longitudinal axis 74, corresponding to the undeployed position 80 of the fin blade 20.

With continued reference to FIG. 3, an indentation 112 is cut into the periphery 108 of the hub 70. The indentation 112 is approximately opposite the receiving groove 110, subtends an angle of approximately 50° about the hub axis 104, is cut-in so as to reduce the radius of the hub by approximately 3 millimeters, and is cut to a depth equaling the hub height 105, i.e., all the way from the hub face 106 to the platform surface 101. The indentation 112 functions as part of the mechanism that locks the fin blade 20 in the deployed position 82 as is set forth in detail with reference to FIGS. 6 through 8.

With continued reference to FIG. 3, a deployment lock 122 is rotatably attached to the surface 101 of the platform 100 between the hub 70 and the bottom 58 of the boot 50. The deployment lock 122 rotates in a plane parallel to the platform surface 101 about a fastener 144 which is located proximate the hub periphery 108 and slightly forward of the indentation 112. The deployment lock 122 is generally flat, has a height approximating the height 105 of the hub 70 and has an edge 124. The edge 124 defines a deployment angle limiting notch 126 flanked by a first arc 128 and a second arc 130. The first arc 128, immediately forward of the notch 126, fits against the indentation 112 in the periphery 108 of the hub 70. The second arc 130, immediately behind the notch 126, fits against the periphery 108 of the hub 70. The notch 126 is linear, has a width of approximately 5 millimeters, has a length of approximately 12 millimeters and is centered on and oriented parallel to a radius extending from the hub axis 104, parallel to the boot longitudinal axis 74, toward the boot bottom 58 (see FIG. 1).

The deployment lock 122 is normally biased toward the hub periphery 108. In this exemplary embodiment, a spring 125 is coiled about the fastener 144 and impinges upon the corner portion 142 of the cap 138 and upon the deployment lock 122. Alternative embodiments may include, for example, a leaf spring adjacent the deployment lock 122. Also alternatively, a spring may be omitted if the deployment lock 122 itself includes an elastic portion.

The angle limiting notch 126 functions as part of the mechanism that locks the fin blade 20 in the deployed position 82 as is set forth in detail with reference to FIGS. 6 through 8. The deployment lock 122 also includes a handle portion 132 which projects toward the front 52 of the boot 50 and which is manipulable to rotate the deployment lock 122.

With continued reference to FIG. 3, a cap 134 covers the face 106 of the hub 70. The cap 134 has a height of approximately 4 millimeters, a flat cap face 136 and a cap periphery 138. The cap periphery 138 describes a circle having a radius of approximately 23 millimeters about the hub axis 104. A receiving slot 140 is cut into the face and all the way through the cap 134. The receiving slot 140 is linear, has a width of approximately 6 millimeters, a first end 145 describing a semicircle having a radius of approximately 3 millimeters about the hub axis 104 and a second end 147 which defines an opening 149 at the cap periphery 138. The receiving slot 140 is centered directly over and is oriented parallel to the receiving groove 110 of the hub 70. At an angle roughly opposite the receiving slot 140, the cap periphery 138 extends approximately 10 millimeters outside the hub radius to define a corner portion 142 covering a portion of the deployment lock 122. A fastener 144 holds the corner portion 142 approximately the height 105 of the hub 70 away from the surface 101 of the platform 100, allowing the deployment lock 122 to rotate and slide between the corner portion 142 and the platform surface 101. The deployment lock 122 rotates about the fastener 144.

With continued reference to FIG. 3, an exemplary fin blade connector 40 in accordance with the present invention has a mating end 150. The mating end 150 is roughly rail-shaped and has a flat front side 152. A spindle 156 projects perpendicularly from the front side 152. The spindle 156 has a cylindrical stem 158 ending in a cylindrical head 160 coaxial with the stem 158. The stem 158 has a height of approximately 4 millimeters and a diameter of approximately 6 millimeters. The head 160 has a height of approximately 4 millimeters and a diameter of approximately 12 millimeters. It can be appreciated that when the stem 158 and head 160 are approximated to the receiving slot 140 and receiving groove 110, respectively, the spindle 156 will engage the cap 134, hub 70 and platform 100 and may slide toward the hub axis 104 until it is positioned directly over the center bore 102.

Figure 4:
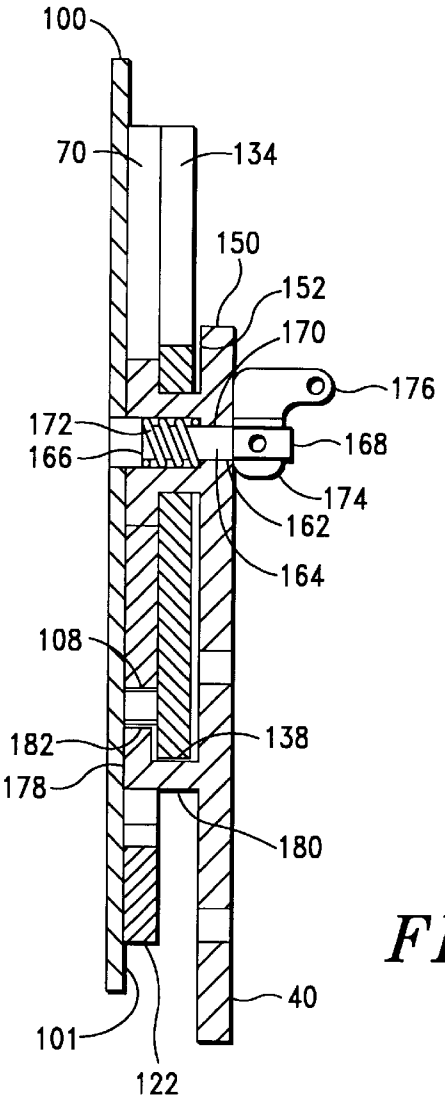

With reference to FIG. 4, a front sectional view is shown of the platform 100, hub 70, lock 122, cap 134, and connector 40 that are depicted in FIG. 3. The mating end 150 has a flattened front side 152 and a flattened backside 154. A through-bore 162, coaxial with the stem 158 and head 160, completely penetrates the mating end 150 from the front side 152 to the backside 154. A centering pin 164 is slidably disposed in the through-bore 162. The centering pin 164 has a nose segment 166 and a tail segment 168. The nose segment 166 and the through-bore 162 are approximately 4 millimeters in diameter. The tail segment 168 is approximately 2 millimeters in diameter. The tail segment 168 projects from the through-bore 162 beyond the back of the mating end 150. The through-bore 162 has a restricted opening 170 at the backside 154 having a diameter slightly larger than that of the tail segment 168. A helical spring 172 is disposed about the tail segment 168 and compressed between the nose segment 166 and the restricted opening 170. The spring 172 biases the centering pin 164 toward the front side 152 of the mating end 150. A pin release 174 is pivotably attached to the tail segment 168 of the centering pin 164 outside the through-bore 162 and is abuttingly disposed against the backside 154 of the mating end 150. The pin release 174 interferes with the restricted opening 170, thereby preventing the centering pin 164 from being ejected from the through-bore 162. The centering pin 164 is long enough that the nose segment 166 projects approximately 4 millimeters beyond the platform surface 101 into the platform 100 while the pin release 174 remains accessible. The pin release 174 has a handle 176, which is operable to pivot the release and to withdraw the centering pin 164 from the center bore 102. With the centering pin 164 withdrawn from the center bore 102, the spindle 156 is free to slide out of the receiving groove 110 and slot 140 at the cap periphery 138, completely detaching the fin blade 20 from the boot 50.

Figure 5:
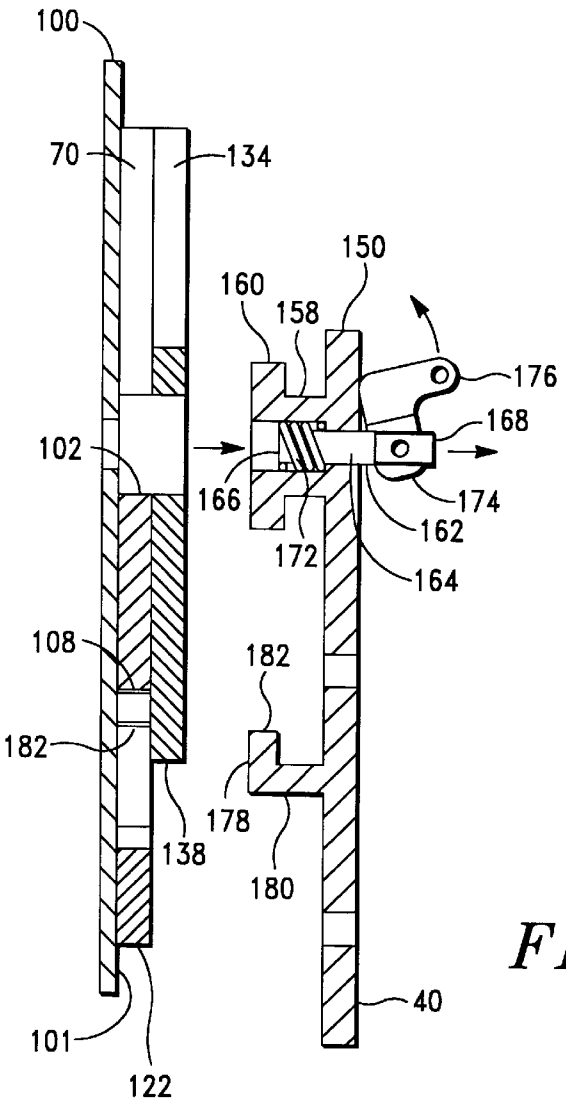
FIGS. 4 and 5 are partial front sectional views of the exemplary embodiment shown by FIG. 3.

With reference to FIG. 5 and also back to FIG. 3, it will be appreciated that when the spindle 156 is positioned over the center bore 102, the nose segment 166 of the centering pin 164 will slide into the center bore 102 and remain there until withdrawn by operation of the pin release 174. As long as the nose segment 166 of the centering pin 164 is engaged in the center bore 102, the spindle 156 will be locked in place and will not slide toward the hub periphery 108.

Referring again to FIGS. 3 and 4, a key 178 projects from the front side 152 of the mating end 150 of the connector 40 approximately 23 millimeters aft of the through-bore 162. The key 178 has a stem 180. An arm 182 projects from the stem 180 at a height of approximately 4 millimeters from the front side 152 of the connector 40 and extends, parallel to the front side 152, approximately 3 millimeters toward the spindle 156. It will be appreciated that when the spindle 156 is engaged over the center bore 102, the stem 180 and arm 182 of the key 178 describe radii barely equal to the cap periphery 138 and hub periphery 108. Thus, the key stem 180 and arm 182 barely reach around the cap periphery 138 (which overhangs the hub periphery 108 by approximately 3 millimeters) and toward the hub periphery 108. As the fin blade 20 is rotated toward the deployed position 82, the key 178 becomes trapped between the cap periphery 138 and the platform surface 101 and can only slide around the periphery.

Figure 6:
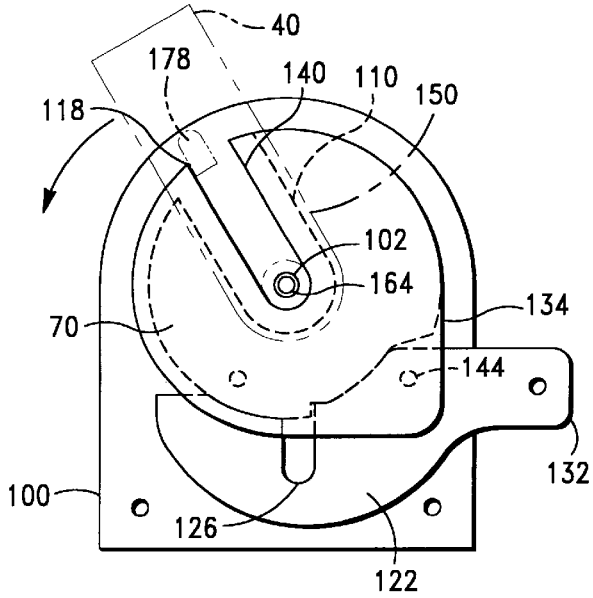
FIGS. 6 through 9 are partial side views of the ankle and connector portions of the mechanism for facilitating the exemplary embodiments of the diving fin according to the present invention to go from the deployed to the undeployed position.

With reference to FIGS. 6 through 9, side views are presented of the platform 100, hub 70, lock, cap 134 and connector 40 of the right lateral and left medial ankle portions 62 (thus, FIGS. 6 through 9 correspond to a mirror image of the exemplary embodiment shown in FIG. 3). FIG. 6 illustrates the connector 40 with the centering pin 164 engaged in the center bore 102. The key 178 is positioned at the opening 118 of the receiving groove 110. The arm 182 of the key 178 extends between the cap 134 and the platform 100 toward the hub periphery 108. The key 178 laterally stabilizes the connector 40 and also relieves the spindle 156 of torsional stresses.

Figure 7:
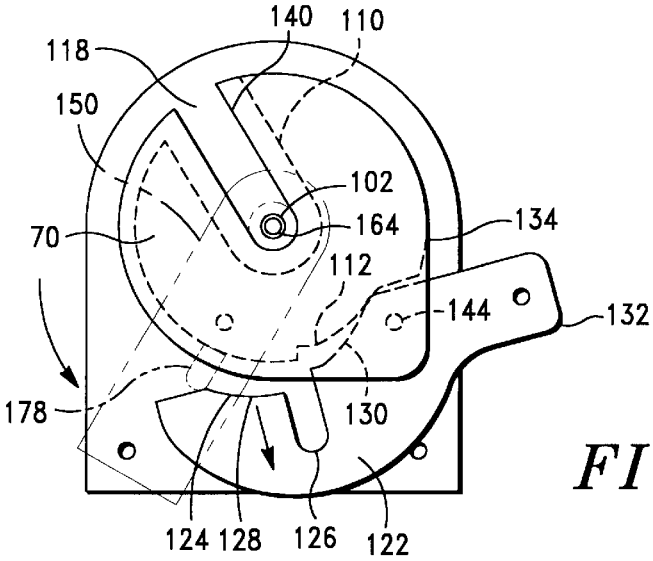
Figure 8:
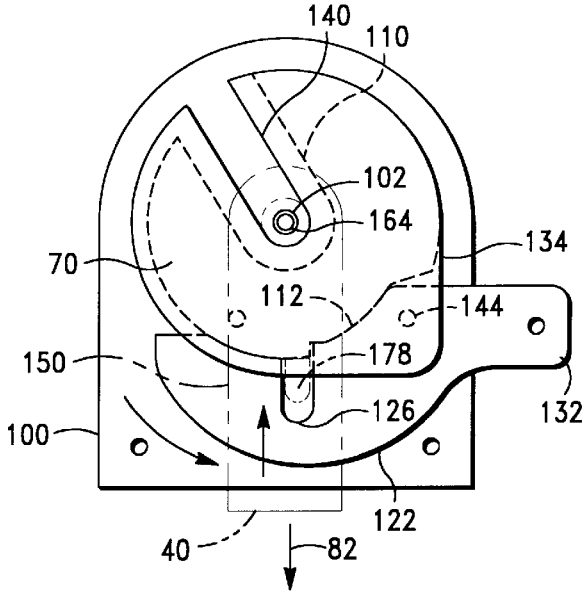

In FIG. 7 it is seen that as the connector 40 is rotated toward the deployed position 82, the key 178 impinges upon the edge 124 of the deployment lock 122, urges the deployment lock 122 away from the hub periphery 108, and slides between the deployment lock 122 and the hub 70. In FIG. 8, the fin blade 20 has rotated to the deployed position (arrow 82). The key 178 is aligned with the angle-limiting notch 126, allowing the deployment lock 122 to return to its normal biased position against the hub 70. With the deployment lock 122 so positioned, the key 178 will not escape the notch 126, and the fin blade 20 will not rotate from the deployed position 82, unless the lock 122 is rotated by some force such as the swimmer manipulating the handle portion 132. It will also be appreciated that the lock edge 124 and the hub periphery 108, which includes the indentation 112, engage interlockingly to allow the hub 70 to support the lock when forces are applied to the fin blade 20.

Figure 9:
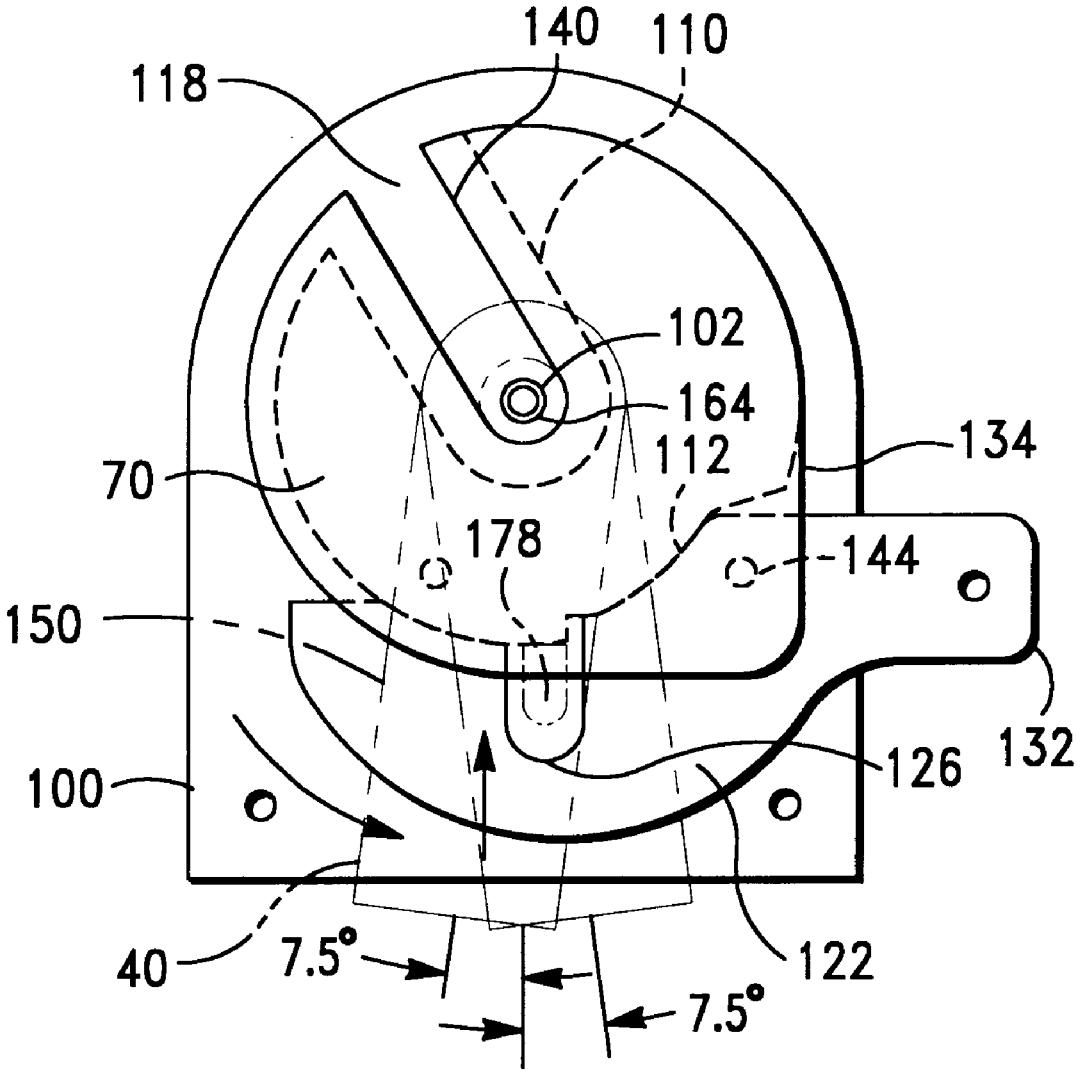

With reference to FIG. 9, another exemplary embodiment of a diving fin according to the present invention is shown. The angle-limiting notch 126 is noticeably wider than the key 178. In contrast to the exemplary embodiment shown in FIG. 8, which keeps the connector 40 very closely aligned with boot longitudinal axis 74, this exemplary embodiment allows the connector 40 to wobble a few degrees either way while retaining it in the deployed position 82. In a preferred embodiment, the width of the notch 126 and key 178 are selected such that the connector 40 deviates up to 7.5° away from the boot longitudinal axis 74 in either direction. In another preferred embodiment, this range of deviation is 15°. The advantage of this feature is that, depending on the dimensions and flexibility of the fin blade 20, the blade angle can change quickly at the beginning or end of a stroke in order to reach a propulsive angle nearly as soon as the stroke begins.

With reference to FIG. 10, another exemplary embodiment of a diving fin according to the present invention is illustrated in which the boot 50 is modified to fit the lower leg of a swimmer having a missing or malformed foot. The fastener assembly 76 closes the front 52 of the boot 50 about the distal portion of the swimmer's lower leg. The front 52, back 54 and sides 62 and 64 distribute stresses over a large area and secure the boot 50 to the swimmer. It will be appreciated that the diving fin of the present invention does not require the swimmer to have a normally formed foot, nor even an articulated foot, in order to orient the deployed blade 20 at a propulsive angle. As long as there is sufficient limb and bone structure to stably support the boot 50, the swimmer can enjoy the advantages of the present invention.

The connector 40, spindle 156, cap 134, lock 122, hub 70, platform 100 and centering pin 164 are likely to be subjected to extremes of stress, torque and abrasion. Therefore, these parts must be formed of a material combining stiffness, hardness, tensile strength and compressive strength. A high-strength steel or other alloy is appropriate. Preferably, the material resists the corrosive effects of seawater. Preferably, dissimilar metals are not placed in electrical contact in a manner, which would tend to hasten corrosion. Depending on the dimensions and configuration of the parts, it may be feasible to form some of the above parts of a composite, which includes, for example, a ceramic, polymeric or fibrous material.

While the foregoing describes several embodiments of a diving fin in accordance with the present invention, it is to be understood that the above description is illustrative only and not limiting of the disclosed invention. It will be appreciated that it would be possible for one skilled in the art to modify a number of aspects of the fin blade 20, connector 40, cap 134, lock 122, hub 70, platform 100 and centering pin 164. For example, different mounting mechanisms might be employed in place of the spindle 156, receiving groove 110 and slot 140 set forth herein, so long as the claimed features are provided. Additionally, the dimensions set forth in the foregoing description are illustrative and may be modified within the spirit of the invention. In particular, for example, the dimensions of the hub 70, cap 134, bore 102 and spindle 156 may be altered as needed to accommodate anticipated loads. Accordingly, the present invention is to be limited only by the claims as set forth below.

What is claimed is:

1. A diving fin to be worn by a swimmer, comprising:

a fin blade;

a boot for coupling the fin blade to the swimmer, the boot having a top, a bottom, a front, a back, a medial side and a lateral side, a boot longitudinal axis being defined by a line passing through the top and bottom substantially parallel to the back and the sides;

the fin blade being detachable to the boot;

the boot being capable of positioning the attached fin blade parallel to the boot longitudinal axis; and a hub affixed to the boot, a connector projecting from the fin blade, and the connector being lockably engageable with the hub, whereby the fin blade is held to the boot proximate the swimmer's ankle and projects past the swimmer's heel in line with the swimmer's lower leg and whereby the fin blade is readily attachable to and detachable from the boot.

2. A diving fin as set forth in claim 1, wherein the fin blade while attached to the boot has an undeployed position wherein the attached fin blade is rotatably attached to the boot and a deployed position wherein the attached fin blade projects from the boot substantially parallel to the boot longitudinal axis, the attached fin blade being rotatable from the undeployed position to the deployed position and lockable in the deployed position, whereby, the swimmer may orient the fin blade away from the ground and walk freely.

3. A diving fin as set forth in claim 2, wherein:

the fin blade comprises leading, trailing, medial and lateral edges and top and bottom surfaces and, a blade longitudinal axis being defined by a line intersecting the leading and trailing edges, a forward direction being defined as from the trailing edge to the leading edge, a blade transverse axis being defined by a line intersecting the medial and lateral edges and intersecting the longitudinal axis at a right angle;

a boot transverse axis is defined as a line passing approximately through the medial and lateral sides of the boot and intersecting the boot longitudinal axis at a right angle; and the fin blade when attached to the boot in the deployed position is oriented away from the hub and past the bottom so that the blade longitudinal axis is roughly aligned with the boot longitudinal axis and the blade transverse axis is roughly parallel to the boot transverse axis, whereby the deployed attached blade projects from the hub past the swimmer's heel in substantial alignment with the swimmer's lower leg and the top and bottom surfaces of the fin blade face the same directions as the swimmer's shin and calf, respectively.

4. A diving fin as set forth in claim 3, wherein:

at least one connector projects from the fin, the connector having a mating end;

at least one hub is affixed to the boot, the hub and the mating end being lockingly engageable; and the boot includes locking means, the locking means keeping the attached fin blade oriented in the deployed position relative to the boot.

5. A diving fin as set forth in claim 3, wherein:

at least one connector projects from the fin, the connector having a mating end;

at least one hub is affixed to the boot, the hub and the mating end being lockingly engageable; and the hub includes locking means, the locking means keeping the attached fin blade oriented in the deployed position relative to the boot.

6. A diving fin as set forth in claim 3, wherein:

the boot has a medial ankle portion and a lateral ankle portion;

a platform is affixed to each ankle portion, each platform having a substantially flat surface and a center bore centrally located in the surface, the center bore defining a hub axis substantially parallel to the boot transverse axis;

a hub is affixed to each platform, the hub defining a flat base affixed to the platform surface, a face opposite the base, a hub periphery, and groove in the face, the groove opening at the hub periphery, ending opposite the center bore and communicating with the center bore;

a cap is affixed to the ankle portion of the boot, the cap covering the hub face, the cap defining a cap periphery and a slot, the slot opening at the cap periphery, ending opposite the center bore and paralleling the groove therebetween, the slot being narrower than the groove; and a medial connector and a lateral connector project from the fin proximate the leading edge thereof, each connector having a mating end, each mating end defining a face and a backside;

a spindle projects from each connector face, the spindle having a stem, a distal end which forms a head, and a through bore running from the end to the backside, the head being dimensioned to enter sideways into the groove at the hub periphery and to slide in the groove, the stem being dimensioned to enter sideways into the slot at the cap periphery and to slide in the slot while holding the head in the groove, the head being dimensioned to be confined in the groove between the cap and the platform surface; and a centering pin is movably disposed in each through bore, the centering pin being dimensioned to fit into the center bore while being manipulable at the backside of the mating end, the centering pin having a locking position projecting into the center bore and a non-locking position withdrawn from the center bore, whereby the fin blade is lockaby attachable to the boot.

7. A diving fin as set forth in claim 6, further comprising angle limiting means for keeping the blade longitudinal axis oriented in substantial alignment with the boot longitudinal axis when the fin blade is attached to the boot in the deployed position.

8. A diving fin as set forth in claim 6, wherein the boot has a first angle limiting surface, the connector has a second angle limiting surface and the first and second angle limiting surfaces are engageable to keep the blade longitudinal axis oriented in substantial alignment with the boot longitudinal axis when the fin blade is attached to the boot in the deployed position.

9. A diving fin as set forth in claim 6, the connector has a first angle limiting surface, the ankle portion of the boot has a second angle limiting surface and the first and second angle limiting surfaces are lockingly engageable to keep the blade longitudinal axis substantially aligned with the boot longitudinal axis when the fin blade is attached to the boot in the deployed position.

10. A diving fin as set forth in claim 6, wherein:

a key projects from the connector;

the ankle portion of the boot defines a keyway and a restraining mechanism;

the key is slidable along the keyway when the connector is rotated between the deployed and undeployed positions while attached to the boot;

restraining mechanism and key are lockingly engageable when the connector is attached to the boot and in the deployed position; and the key and restraining mechanism keep the connector in the deployed position when so engaged.

11. A diving fin as set forth in claim 6, wherein:

the hub periphery defines a circular surface having a hub radius about the hub axis;

the cap periphery defines a circular surface having a cap radius about the hub axis, the cap radius being greater than the hub radius such that the periphery of the cap overhangs the periphery of the hub;

a spindle axis is defined as the center of the through bore through the spindle and mating end;

a key projects from the face of the connector approximately one cap radius from the spindle axis;

the key includes an arm projecting therefrom toward the spindle, the arm having an end approximately one hub radius from the spindle axis;

the key is slidably disposed proximate the cap periphery when the centering pin is engaged in the center bore, the arm then being slidably disposed proximate the hub periphery and between the cap periphery and the platform surface;

a deployment lock is attached to the ankle portion of the boot and defines an angle limiting surface so disposed proximate the hub periphery as to lockingly engage the key when the connector is in the deployed position;

whereby, when the connector is in the deployed position, the centering pin and center bore cooperate to confine the key to the cap periphery, the cap periphery and platform surface cooperate to confine the key arm therebetween and thereby cooperate with the spindle head to stabilize the blade longitudinal axis substantially perpendicular to the boot transverse axis, and the key and deployment lock cooperate to limit the blade longitudinal axis to within a determined angle from the boot longitudinal axis as measured about the boot transverse axis.

12. A diving fin as set forth in claim 11, wherein the deployment lock has a locking position and a releasing position, is movable therebetween and is biased in the locking position, the angle limiting surface defines a notch, rotation of the connector from the undeployed position into the deployed position urges the deployment lock to the releasing position whereupon the notch receives the key, the deployment lock returns to the locking position and the notch traps the key, limiting the rotational position of the spindle relative to the hub to within a determined angle.

13. A diving fin as set forth in claim 12, wherein the deployment lock is rotatably attached to the ankle portion of the boot.

14. A diving fin as set forth in claim 13, wherein the cap defines an extension over the platform surface, a fastener connects the extension to the platform and the deployment lock is rotatably disposed about the fastener.

15. A diving fin as set forth in claim 11, further comprising a release manually operable to engage and disengage the key and angle limiting surface.

16. A diving fin as set forth in claim 3, wherein:

first and second connectors project from the fin blade, each connector defining a mating end;

first and second hubs are affixed to the boot;

each hub is lockingly engageable with a mating end so as to keep the fin blade attached to the boot, and the boot includes locking means, the locking means keeping the attached fin blade oriented in the deployed position relative to the boot.

17. A diving fin as set forth in claim 3, wherein:

first and second connectors project from the fin blade, each connector defining a mating end;

first and second hubs are affixed to the boot;

each hub is lockingly engageable with a mating end so as to keep the fin blade attached to the boot, and the ankle portion of the boot includes locking means, the locking means keeping the attached fin blade oriented in the deployed position relative to the boot.

18. A diving fin as set forth in claim 2, wherein, when the fin blade is locked in the deployed position, the blade longitudinal axis is confined to within approximately 15° of parallel to the boot longitudinal axis in a plane roughly perpendicular to the boot transverse axis, whereby, the fin blade may readily assume a propulsive angle in the water at the beginning and end of each kick.

19. A diving fin as set forth in claim 2, wherein, when the fin blade is locked n the deployed position, the blade longitudinal axis is confined to within approximately 7.5° of parallel to the boot longitudinal axis in a plane roughly perpendicular to the boot transverse axis, whereby, the fin blade may readily assume a propulsive angle in the water at the beginning and end of each kick.

20. A diving fin as set forth in claim 1, wherein the hub defines a bore, the connector defines a spindle, the spindle is engageable with the hub at the bore, and the hub includes a locking means for keeping the connector engaged at the bore.

21. A diving fin as set forth in claim 1, wherein the hub has a face, the face has a bore, a periphery and a groove opening at the periphery and ending at the bore, a hub cap is affixed to the boot, the hub cap covers the face, the hub cap has a periphery and a slot, the slot opens at the hub cap periphery and ends over the bore;

a spindle projects from the connector, the spindle is insertable into the groove and slot, and while inserted therein is held in the groove by the cap, and while held in the groove is slidable to a position aligned with the bore; and a centering pin projects movably from the spindle, the centering pin being insertable into the bore whereupon the centering pin locks the spindle in alignment with the bore, the centering pin being withdrawable from the bore to unlock the spindle from alignment with the bore, whereby, the swimmer may approximate the spindle to the groove at the periphery of the hub, slide the spindle in the groove toward the bore, and insert the centering pin into the bore to lock the fin blade onto the boot.

22. A diving fin to be worn by a swimmer, comprising:

a fin blade;

a boot for coupling the fin blade to the swimmer, the boot having a top, a bottom, a front, a back, a medial side and a lateral side, a boot longitudinal axis being defined by a line passing through the top and bottom substantially parallel to the back and the sides;

the fin blade being attachable to the boot;

the boot holding the attached fin blade in an orientation substantially dependent upon the orientation of the boot, whereby the blade is oriented independently of the elevation and extension of the swimmer's toes and the swimmer is able to kick powerfully and efficiently without hyperextension of the foot.

23. A diving fin as set forth in claim 22, wherein the fin blade is detachable from the boot, whereby the swimmer may wear the boot without the fin blade and may attach the fin blade to the boot while wearing the boot.

24. A diving fin as set forth in claim 22, wherein the fin blade while attached to the boot has an undeployed position wherein the attached fin blade is rotatably attached to the boot and a deployed position wherein the attached fin blade projects from the boot, in line with the boot longitudinal axis, in a direction defined from the top of the boot toward the bottom of the boot, the attached fin blade being rotatable from the undeployed position to the deployed position and lockable in the deployed position, whereby the swimmer may orient the fin blade away from the ground to walk without tripping on the fin blade and may lock the fin in the deployed position for swimming.

25. A diving fin as set forth in claim 24, wherein:

the fin blade comprises leading, trailing, medial and lateral edges and top and bottom surfaces, a blade longitudinal axis being defined by a line intersecting the leading and trailing edges, a forward direction being defined as from the trailing edge to the leading edge, a blade transverse axis being defined by a line intersecting the medial and lateral edges and intersecting the longitudinal axis at a right angle;

the boot defines a boot transverse axis as a line passing approximately through the medial and lateral sides of the boot and intersecting the boot longitudinal axis at a right angle; and the fin blade when attached to the boot in the deployed position is oriented away from the hub and past the bottom so that the blade longitudinal axis is roughly aligned with the boot longitudinal axis and the blade transverse axis is roughly parallel to the boot transverse axis, whereby the deployed attached blade projects from the hub past the swimmer's heel in substantial alignment with the swimmer's lower leg and the top and bottom surfaces of the fin blade face the same directions as the swimmer's shin and calf, respectively.

26. A diving fin as set forth in claim 25, wherein:

at least one connector projects from the fin, the connector having a mating end;

at least one hub is affixed to the boot, the hub and the mating end being lockingly engageable; and the hub includes locking means, the locking means keeping the attached fin blade oriented in the deployed position relative to the boot.

27. A diving fin as set forth in claim 25, wherein:

first and second connectors project from the fin blade, each connector defining a mating end;

first and second hubs are affixed to the boot;

each hub is lockingly engageable with a mating end so as to keep the fin blade attached to the boot, and the boot includes locking means, the locking means keeping the attached fin blade oriented in the deployed position relative to the boot.

28. A diving fin as set forth in claim 23, wherein a hub is affixed to the boot, a connector projects from the fin blade, and the connector is lockably engageable with the hub, whereby the fin blade is readily attachable to and detachable from the boot.

* * * * *